US007811032B2

(12) United States Patent
Short

(10) Patent No.: US 7,811,032 B2
(45) **Date of Patent: *Oct. 12, 2010**

(54) METHODS AND DEVICES FOR GROUND STABILIZATION

(76) Inventor: Richard Donovan Short, 4125 Blackhawk Plaza Cir., Blackhawk, CA (US) 94506

( * ) Notice: Subject to any disclaimer, the term of this patent is extended or adjusted under 35 U.S.C. 154(b) by 390 days.

This patent is subject to a terminal disclaimer.

(21) Appl. No.: 11/893,044

(22) Filed: Aug. 14, 2007

(65) Prior Publication Data

US 2009/0080983 A1 Mar. 26, 2009

(51) Int. Cl.
*E02D 17/20* (2006.01)
*E02D 5/80* (2006.01)

(52) U.S. Cl. ..... 405/302.4; 405/231; 405/259.1; 52/156; 256/65.14

(58) Field of Classification Search ..... 405/231, 405/244, 252, 258.1, 259.1, 284–286; 256/DIG. 5, 256/65.02, 65.14; 52/155, 156, 165
See application file for complete search history.

(56) References Cited

U.S. PATENT DOCUMENTS

| | | | | |
|---|---|---|---|---|
| 1,073,278 | A | 9/1913 | Mosher | |
| 1,109,020 | A | 9/1914 | Skiff et al. | |
| 1,408,322 | A | 2/1922 | Zimmerman | |
| 1,433,621 | A | 10/1922 | Hutton | |
| 2,880,588 | A | 4/1959 | Moore | |
| 3,412,561 | A | 11/1968 | Reid | |
| 4,252,472 | A | 2/1981 | Moraly | |
| 4,530,190 | A | 7/1985 | Goodman | |
| 4,615,156 | A | 10/1986 | Deike | |
| D334,121 | S | 3/1993 | Van Handel, III | |
| 5,797,706 | A | 8/1998 | Segrestin et al. | |
| 6,524,027 | B1 | 2/2003 | Fabius | |
| 6,659,682 | B2 | 12/2003 | Heeks | |
| 6,666,625 | B2 | 12/2003 | Thonton | |
| 7,090,440 | B1 * | 8/2006 | Short | 405/302.4 |
| 2005/0042038 | A1 | 8/2005 | Irvine | |

FOREIGN PATENT DOCUMENTS

| | | |
|---|---|---|
| DE | 4226067 | 6/1992 |
| JP | 57071931 | 5/1982 |

* cited by examiner

*Primary Examiner*—Tara Mayo-Pinnock
(74) *Attorney, Agent, or Firm*—Adams Law Office; Sharon Adams

(57) ABSTRACT

Methods and devices for stabilizing slopes created by human activity during, for example, building construction, road construction, golf course construction, or other type of construction, where a plurality of plate piles are inserted in a diamond shaped lattice pattern below the ground surface to stabilize. Methods and devices for securing existing slopes around structures where a plurality of plate piles are inserted in a diamond shaped lattice pattern below the ground surface. Methods and devices for stabilizing a waterfront where a series of plate piles are inserted along the waterfront.

15 Claims, 8 Drawing Sheets

METHODS AND DEVICES FOR GROUND STABILIZATION

CROSS REFERENCE TO RELATED APPLICATION

Not Applicable.

FEDERAL SPONSORSHIP

Not Applicable.

BACKGROUND

There are many situations where it is important to stabilize a slope, or non-sloping ground. Steep, unstable slopes may be created during certain types of construction, such as freeway widening, golf course construction, or other types of construction where the ground is altered. These slopes are not naturally occurring, but instead are the result of human activity. These slopes often need stabilization, even when there are no signs of slope failure.

Similarly, it may be desirable for safety reasons, to strengthen certain slopes that are relatively stable, whether naturally occurring or the result of human activity. For example, it is prudent to stabilize slopes behind power plants, or slopes at the base of dams or bridges, even when the slope does not appear to be at or near failure. Also, non-sloping ground adjacent to water may benefit from stabilization.

Most of the research and work on slope and ground stabilization relates to stabilizing landslides. An effective, relatively small-scale method for stabilizing slopes created by human activities, for stabilizing slopes for safety reasons, or for stabilizing non-sloping ground is needed.

Research on mitigation techniques for shallow, colluvial landslides has seen some interest from the geotechnical community in the past 20 years, although most research has been performed on the predictive analysis of these types of slides (e.g. Aubeny and Lytton, 2004; Cho and Lee, 2002; Collins and Znidarcic, 2004; Iverson, 2000). Predictive analysis techniques are an important aspect of understanding slope stability behavior. However, it may be desirable to stabilize ground or slopes, even when there is no direct prediction of failure, for safety reasons.

Existing methods of landslide mitigation have been summarized by Rogers (1992). They include excavation and recompaction, conventional retention structures, subdrainage, soil reinforcement using geomembranes and geosynthetics, mechanically stabilized embankments, and combination mechanically stabilized retention structures.

Unfortunately, most of these mitigation options are often not useful, mainly due to economic considerations. Retention structures, soil reinforcement options, mechanically stabilized embankments, and combination structures all require large volumes of earthworks in addition to comparatively expensive and time consuming installation methods. The present invention minimizes the need for large machinery and thereby allows slope and ground stabilization around existing homes, and in other areas with limited access.

Others, such as Ito et al. (1981, 1982), have addressed rotational landslides. These deep landslides have been mitigated with extremely long (25 to 100 feet) columns (piles) placed in a portion of the potential slide area, generally at the toe of the slope to lock down the base of the potential slide. However, these long, heavy piles are often prohibitively expensive. The present invention allows for locking down a slope or ground by placing relatively small, lightweight plate piles throughout the target area.

SUMMARY OF THE INVENTION

Slopes may be created during many different types of construction, such as freeway widening, golf course construction, bridge construction, railroad construction, or building construction where the ground is excavated. These slopes are not naturally occurring, but instead are the result of human activity. The increased slope angle caused by construction may need stabilization, even when there are no outward signs of slope failure.

In other situations, it may be desirable for safety reasons to strengthen existing slopes that appear stable. For example, it is prudent to stabilize naturally occurring slopes surrounding power plants or naturally occurring bridge abutments, even when the slope does not appear to be at or near failure.

A slope or flat ground that is near water also may become unstable due to the action of the water. This flat or sloping ground may need stabilization to prevent erosion, or to strengthen an existing surface.

The present invention consists of identifying a ground surface that is in need of stabilization. After determining the surface in need of stabilization, a sufficient quantity of plate piles are inserted below the ground surface in a diamond-shaped lattice pattern over the entire surface area in need of stabilization.

The plate piles consist of a steel plate attached to a long steel pile 12. The plates may be any size sufficient to retain earth, and are frequently sized two feet by one foot by three-eighths inch thick. Each plate 14 may have one or more holes 16 to allow the plates to be connected via a cable, or to facilitate withdrawal of the plate piles. Pile 12 may be either a pole or an angle.

The plate piles 10 are driven below the soil surface and are not visible, thus preserving the aesthetic appearance of the surface. The collective effect of the numerous plate piles, and the diamond-shaped lattice pattern of insertion reduces or eliminates soil movement.

DETAILED DESCRIPTION OF THE INVENTION

The method may be used with any type of soil, on any slope surface and any slope angle. It is frequently used with clay or silt soil because these soil types are particularly susceptible to slides and are sufficiently soft enough to allow insertion of the plate piles 10.

Figure 7A:
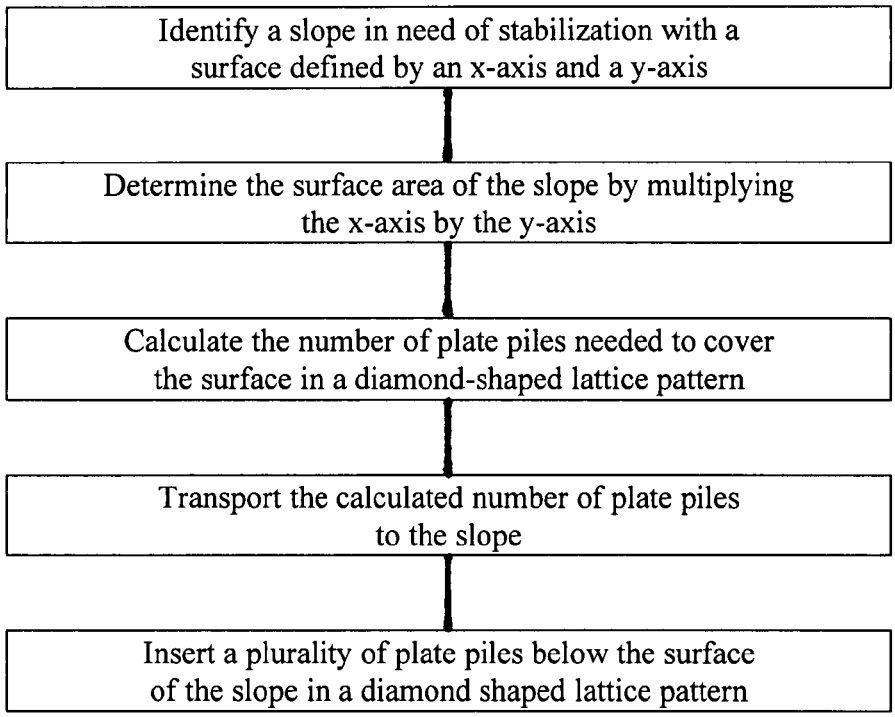
FIG. 7 is a flow chart of the method of the invention.
Figure 7B:
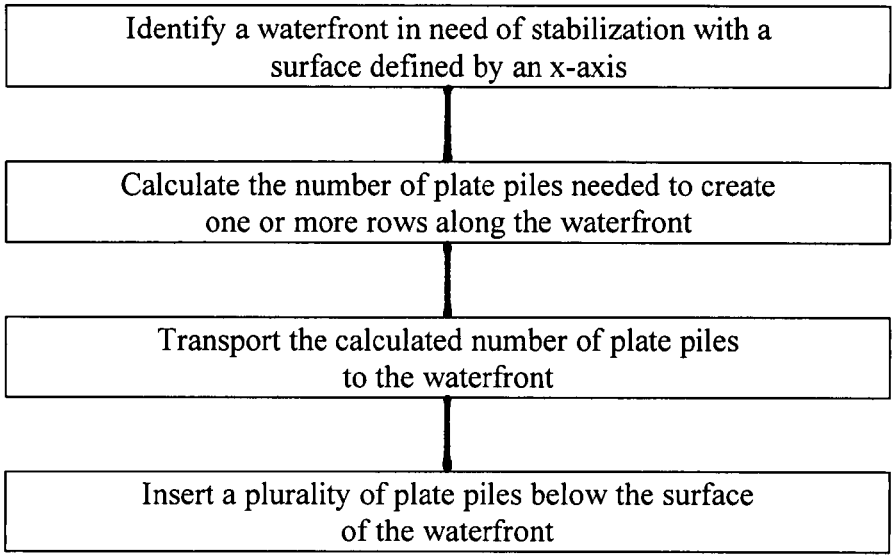

As shown in FIG. 7, in one embodiment, the first step is to identify a slope, where the slope angle has increased due to human activity. This can happen in ways too numerous to mention. Non-limiting examples of such human activity are road construction or widening, golf course construction, bridge construction, power plant construction, railroad construction, or building construction.

Figure 1:
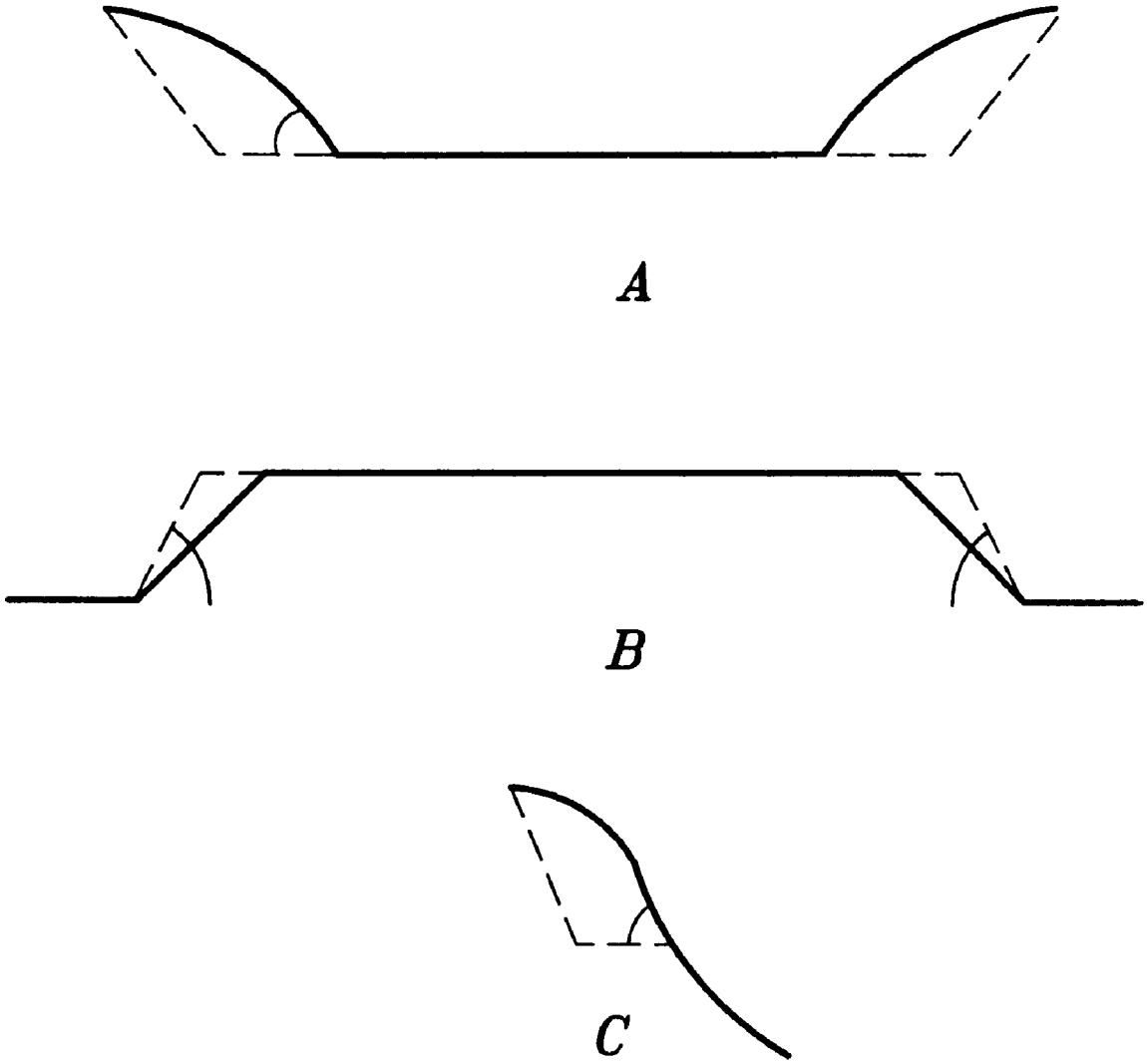
FIG. 1 shows cross-sectional views of different types of road widening or construction, where the dotted lines represent the widened road and new slope with an increased acute slope angle.

Road widening can lead to an increased slope angle. When an existing road is bounded by one or more slopes, going up or down, it may be necessary to increase the slope angle to widen the road, as shown in FIG. 1. The slope angle is determined by measuring the acute angle between a horizontal plane and the slope surface. This embodiment of the method may be especially useful in tight spaces because the road and adjoining slopes will not require additional space if the slope angle can be safely increased. If the road sits at the bottom of one or more slopes, widening the road will cut into the toe of an existing slope, and will increase the slope angle, as shown in FIG. 1A.

When an existing road sits at the top of a rise, it may be necessary to add dirt or other landfill to widen such a road. In this case, the addition of dirt or landfill will increase the acute slope angle, as shown in FIG. 1B. Using an embodiment of the invention will stabilize the newly created, steeper slope.

Likewise, in new road construction, a road may be placed on a hillside in such a way that part of the hillside must be excavated, as shown in FIG. 1C. Again, the slope angle is increased after the road is in place.

In any such situation an embodiment of the invention may be used to stabilize the new slope with its increased slope angle. The user will determine a surface area on the slope that is in need of stabilization. The surface area is determined by calculating the vertical height and horizontal length of the new slope. The horizontal length of the new slope corresponds with an x-axis, and the newly angled, upward slope surface corresponds with a y-axis.

There are many other situations where human activity causes an increase in acute slope angle, and where embodiments of the method may be used. For example, during construction of commercial or residential buildings, particularly those with construction below the ground surface level. In these situations, workers and their equipment must work below the natural ground level. Worker safety may be increased by using an embodiment of the invention to strengthen or stabilize any slopes leading from the natural ground level down to the construction surface. The user will again determine the surface area on the slope that is in need of stabilization. The surface area is determined by multiplying the horizontal length of the bottom of the slope (the x-axis) with the newly angled, upward slope surface (the y-axis).

Yet another embodiment of the invention may be used to stabilize slopes supporting bridge abutments. These slopes may have no outward signs that show the slope is unstable, nevertheless is may be desirable for safety reasons to strengthen or stabilize these slopes. The user will determine the surface area of the slope to be stabilized by multiplying the horizontal length along the bottom of the slope leading to the abutment (the x-axis) with the angled, upward slope surface leading to the abutment (the y-axis).

In another embodiment of the invention, the user may stabilize or strengthen slopes created during golf course construction. As described above, the user will identify a target slope, and will determine the surface area in need of strengthening. The surface area will be determined by multiplying a horizontal x-axis running the length of the target slope, by a y-axis that corresponds with the sloping surface.

Another embodiment of the invention may be used to strengthen manmade or naturally created slopes around significant structures, for example power plants, dams, bridge abutments, pipelines, shopping centers, residences, businesses, government facilities, railroads, hospitals, or historical landmarks. It may be desirable to strengthen slopes behind or in front of any such structure to reduce or eliminate the possibility of a landslide, soil creep or other soil breakdown. The decision to strengthen or stabilize such a slope is based on geologic mapping. Geologic mapping is a detailed topographic analysis of the ground features, including but not limited to, cracks, outcrops, scarps, slumps, or seepage, as determined by close inspection of the slope by a professional, such as a geologist, an engineering geologist or a geotechnical engineer, trained to recognize the signs of slope failure or potential slope failure.

If the slope is behind the structure, stabilization will reduce the risk of soil collapsing on the structure. If the slope is in front of the structure, stabilization will reduce the risk of the structure moving down the hillside. Again, the user will identify a target surface, and will determine the surface area by multiplying a horizontal x-axis running the length of the area to be stabilized by a y-axis that corresponds to the sloping surface.

Figure 6:
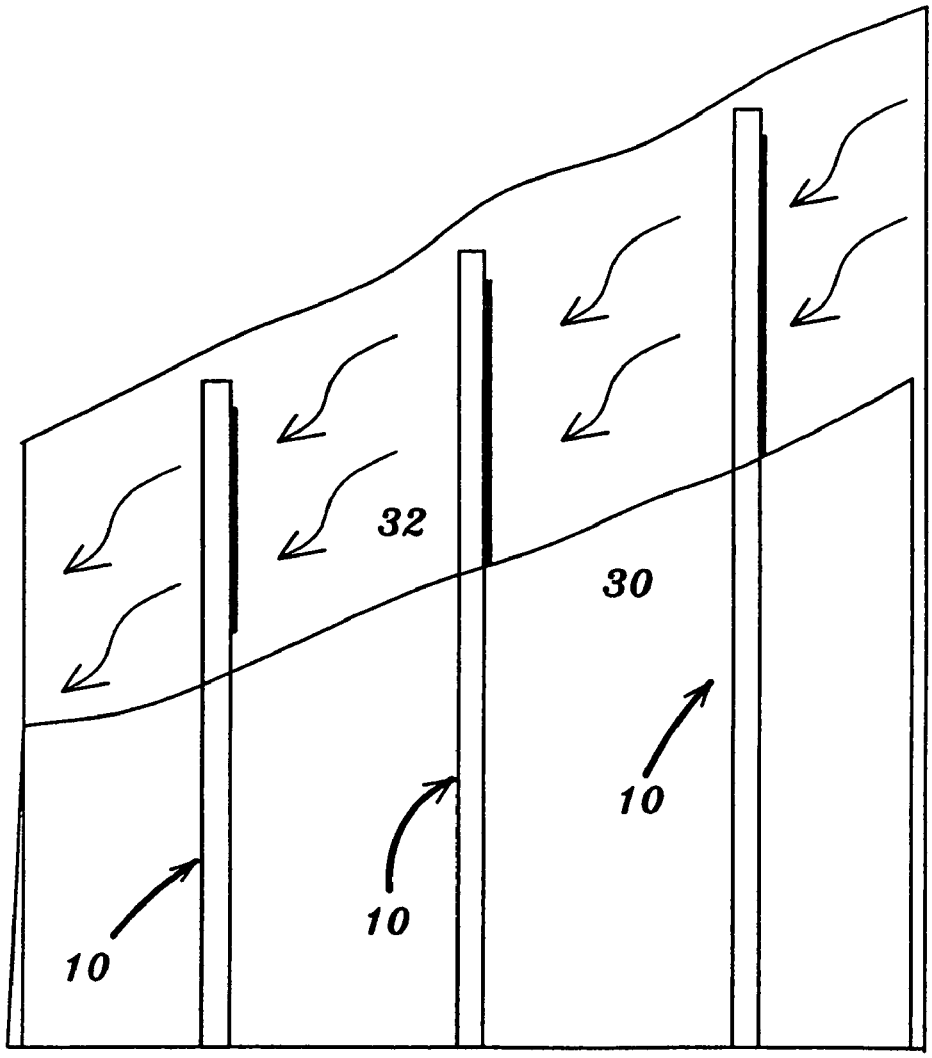
FIG. 6 is a cross-sectional view of the placement of a plurality of plate piles on a slope.

The placement of plates piles may be varied, as needed, depending on soil conditions, slope angle, or other factors. FIG. 6 is a cross-sectional view showing one embodiment of the placement of a plurality of plate piles 10 into the slope to be stabilized. Pile 12 is driven through the soil 32 until plate pile 10 is approximately six inches below the ground surface. The bottom of pile 12 may be driven into bedrock, stable soil, or other stable material 30.

Figure 5:
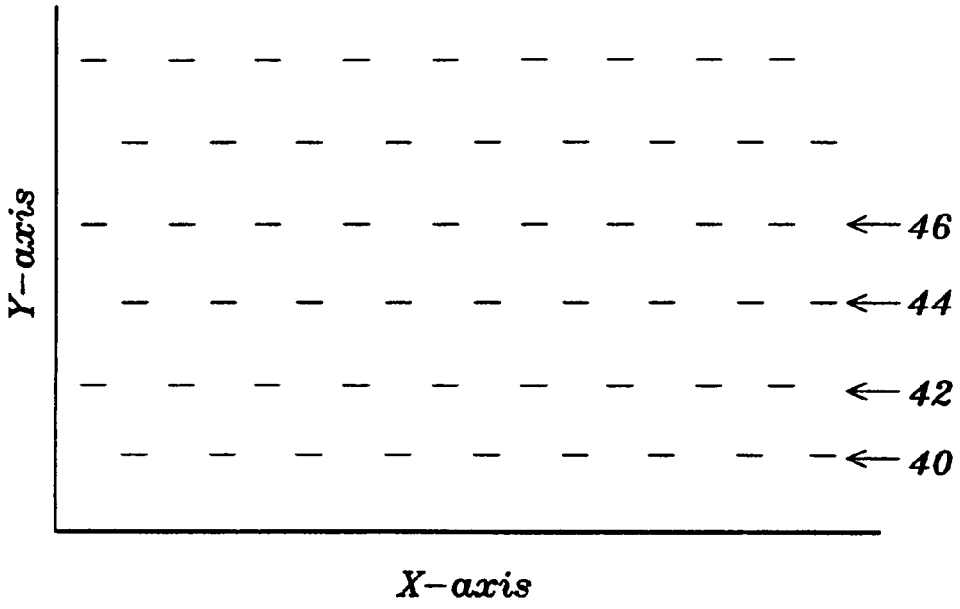
FIG. 5 is a plan view showing the placement of a plurality of plate piles on a ground surface in a diamond shaped lattice pattern.

Plate piles 10 are positioned to induce arching and resist the force of gravity that is attempting to move soil down the slope between plate piles 10. As shown in FIG. 5 the preferred placement to induce arching and stabilize the soil is to place plate piles 10 in a diamond-shaped lattice pattern on the slope.

The plate piles are inserted in the intersection points of the lines of an imagined diamond-shaped lattice so that any given row of plate piles is offset from the previous and subsequent row of plate piles. In the diamond-shaped lattice pattern a first row 40 of plate piles 10 is preferably inserted in a horizontal line along the x-axis of the slope surface, approximately four feet center-to-center. Thus, if using one-foot wide plates 14 there will be a three-foot space between plates 14. A second row 42 of plate piles 10 is inserted anywhere from approximately four to approximately ten feet behind the first row on the y-axis. Each plate pile in the second row is four feet center-to-center on the x-axis. For purposes of this explanation, the second row is either up the target surface from the first row along the y-axis. (In practice, however, the second and subsequent rows may be inserted below the first row.) Plate piles 10 in the second row 42 are not inserted directly behind plate piles 10 in the first row 40. Instead, second-row 42 plate piles 10 are offset from the first-row 40 plates piles 10. Thus, if looking up the target slope the second-row 42 plate piles 10 would be approximately four to ten feet behind and centered in the space between the first-row 40 plate piles 10.

This pattern is repeated as many times as necessary to cover the entire slope surface. Thus, a third row 44 of plate piles 10 would be inserted directly behind the first row along the x-axis, and approximately eight and 20 feet up the slope along the y-axis. A fourth row 46 of plate piles 10 would be offset from the first row along the x-axis, and between 12 and 30 feet up the slope along the y-axis. The horizontal width of each row may be varied to accommodate any changes in the width of the target surface area.

This four-foot center-to-center placement along the x-axis, and offset along the y-axis generally provides sufficient slope stability. However, the exact placement of the plate piles can be varied depending on factors such as slope angle, soil type, size of target surface area, or plate 14 width. Once these factors have been taken into account, plate piles 10 may be inserted in any pattern that will induce arching and will increase the shear stability of the slide mass.

In some situations where extra security is needed, or where the soil needs extra support, the first row 40 of plate piles 10 may be inserted approximately three feet center to center. Subsequent rows will be spaced as described above.

In another embodiment, plate piles 10 at the row at the top of the slope may be inserted approximately three feet center to center. This embodiment is useful when the top row is near a retaining wall, or in other situations where there is a strong downward pressure on the top of the slope.

In another embodiment, the invention may be used to stabilize flat, or relatively flat ground that is adjacent to lakes, rivers or any other waterfront. Waterfront support is different that slope support because the water forces work to degrade the toe of the soil at the water edge. In slope support, the forces of degradation are coming from the uphill direction and include the total mass of the slope.

Waterfront protection is achieved by having at least one row of plate piles spaced approximately three feet apart, center on center, a few feet behind the unstable edge of the waterfront. A few feet can be anywhere from one to ten feet behind, or inland from, the unstable edge of the waterfront. In most cases, this waterfront stabilization will be temporary because water and wave action erodes the soil away from the plate piles 10, and the soil is washed from between the plate piles 10.

In this embodiment, the x-axis is the length of the waterfront to be stabilized. Typically only one row of plate piles 10 is inserted along this x-axis. For additional stability an additional row may be inserted along a y-axis, where the y-axis extends further inland from, and perpendicular to, the waterfront. In this embodiment, the surface area is determined by multiplying the x-axis by the y-axis.

Once the x- and y-axis are determined, the user mathematically calculates the number of plate piles 10 needed to cover the surface area.

After determining the surface area and plate pile pattern, using simple mathematics, the user calculates the number of plate piles 10 needed to cover the entire surface area. Plate piles 10 must be driven into the entire surface area to secure the slope. As shown in FIG. 7, a sufficient number of plate piles 10 are transported to the target site.

The plate piles 10 are inserted into the ground, either in the diamond-shaped lattice pattern, or along the waterfront in a single line, over the entire target surface area. Because the plate piles 10 are relatively small and lightweight, they are preferably inserted into the soil using a small backhoe or excavator although any method of pile driving may be used. Plate piles 10 are preferably inserted approximately six inches below ground surface 32. Given the variations of soil and any possible bedrock depth, this number is only an approximation. However, after insertion, plate piles 10 should not be visible above soil surface 32, as shown in FIG. 6.

Figure 4:
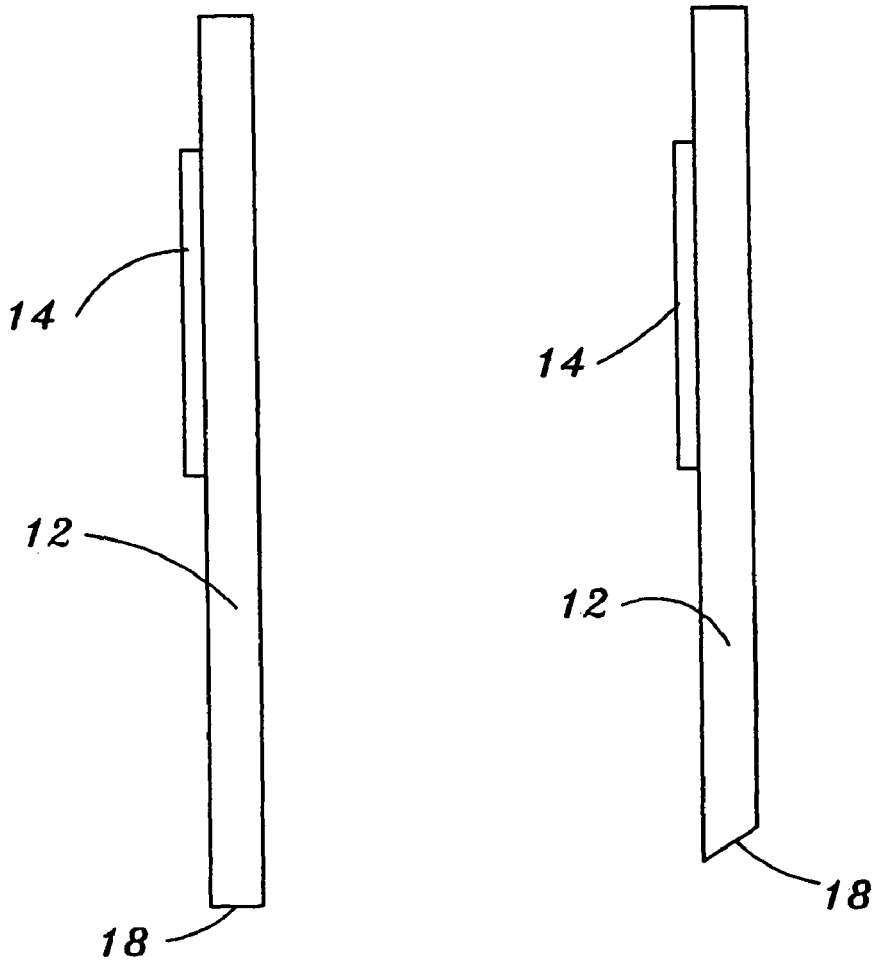
FIG. 4 is a side view of two plate piles.

Each plate pile 10 is preferably made from ⅜" steel, although any rigid material, including but not limited to plastic, metal or steel, that is stable over the project lifetime may be used. Each plate pile 10 consists of a pile 12 and a plate 14. Piles 12 are preferably six feet long, although the length may be increased or decreased as needed to stabilize different soil depths. The six-foot length is preferred because it is long enough to allow plate pile 10 to be securely placed in the ground, while also permitting a single worker to manipulate plate pile 10. Pile 12 may be an angle, to make insertion of the plate piles easier. The angle shape of pile 12 has a higher bending resistance, which results in an increase in the resistance to the gravitational pressure pushing soil down the slope. The bottom edge 18 of pile 12 will be driven into the ground, and may be angled or flat, as shown in FIG. 4.

Figure 2:
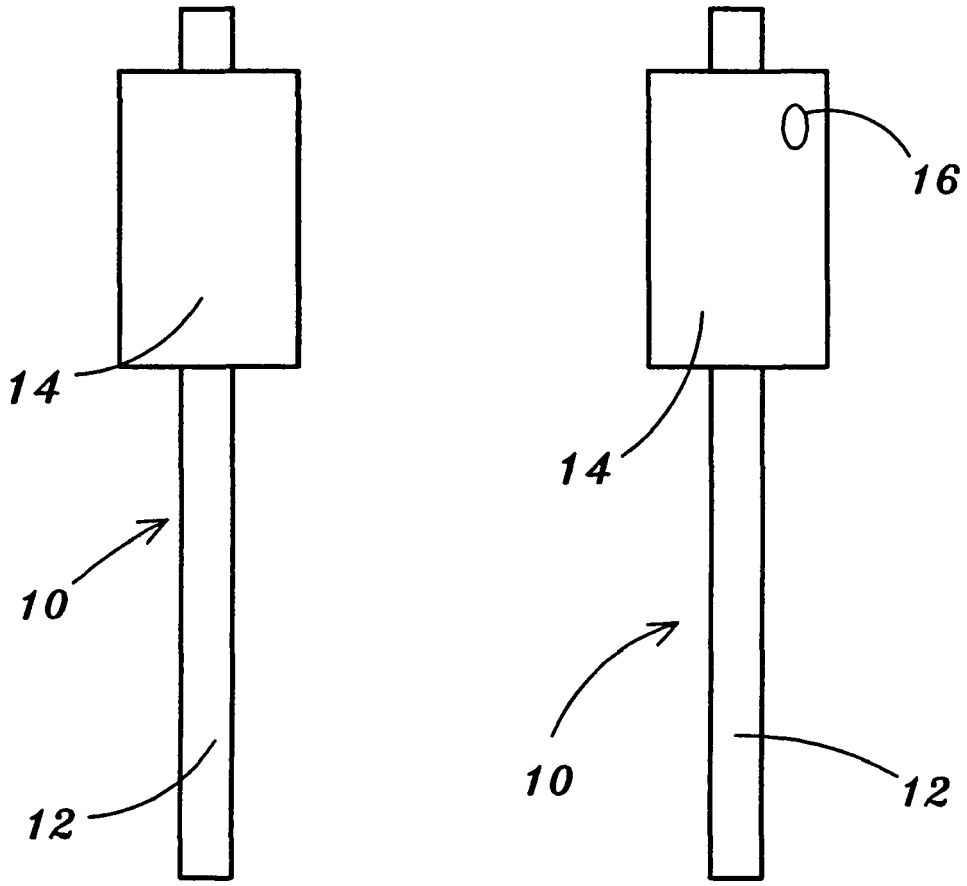
FIG. 2 is a front view of embodiments of two plate piles, one with a single perforation and one without a perforation.
Figure 3:
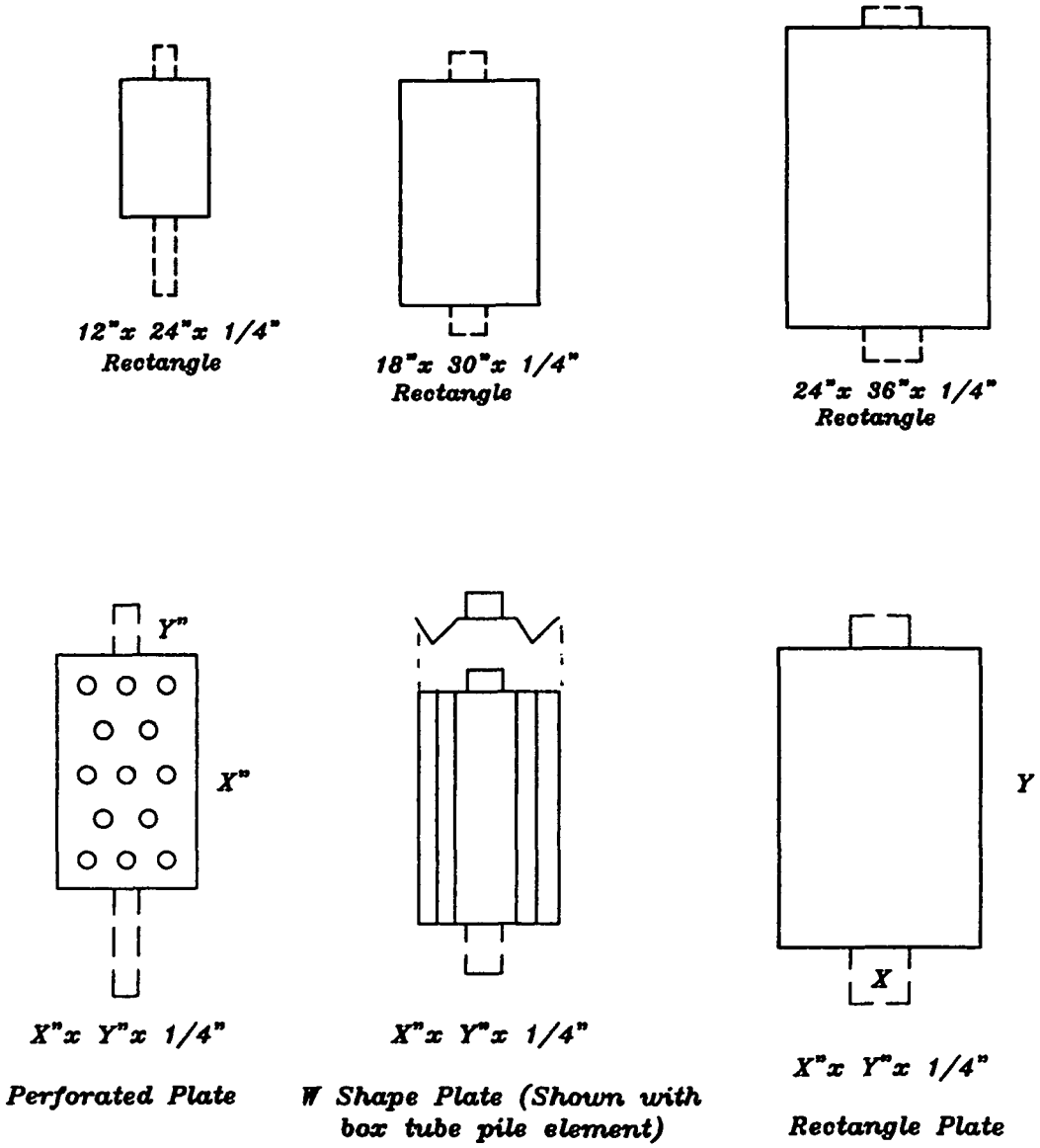
FIG. 3 is a front view of embodiments of differently shaped plate piles

Plate 14 is permanently connected with pile 12, preferably through welding or bolting. Plate 14 may be essentially any shape that has a surface area of approximately two square feet. Different embodiments of plate 14 are shown in FIGS. 2 and 3. In these embodiments plate 14 may be a rectangular shape, a pentahedron shape, a perforated plate with at least one perforation, or a modified-w shape, as shown in FIG. 3.

Figure 8:
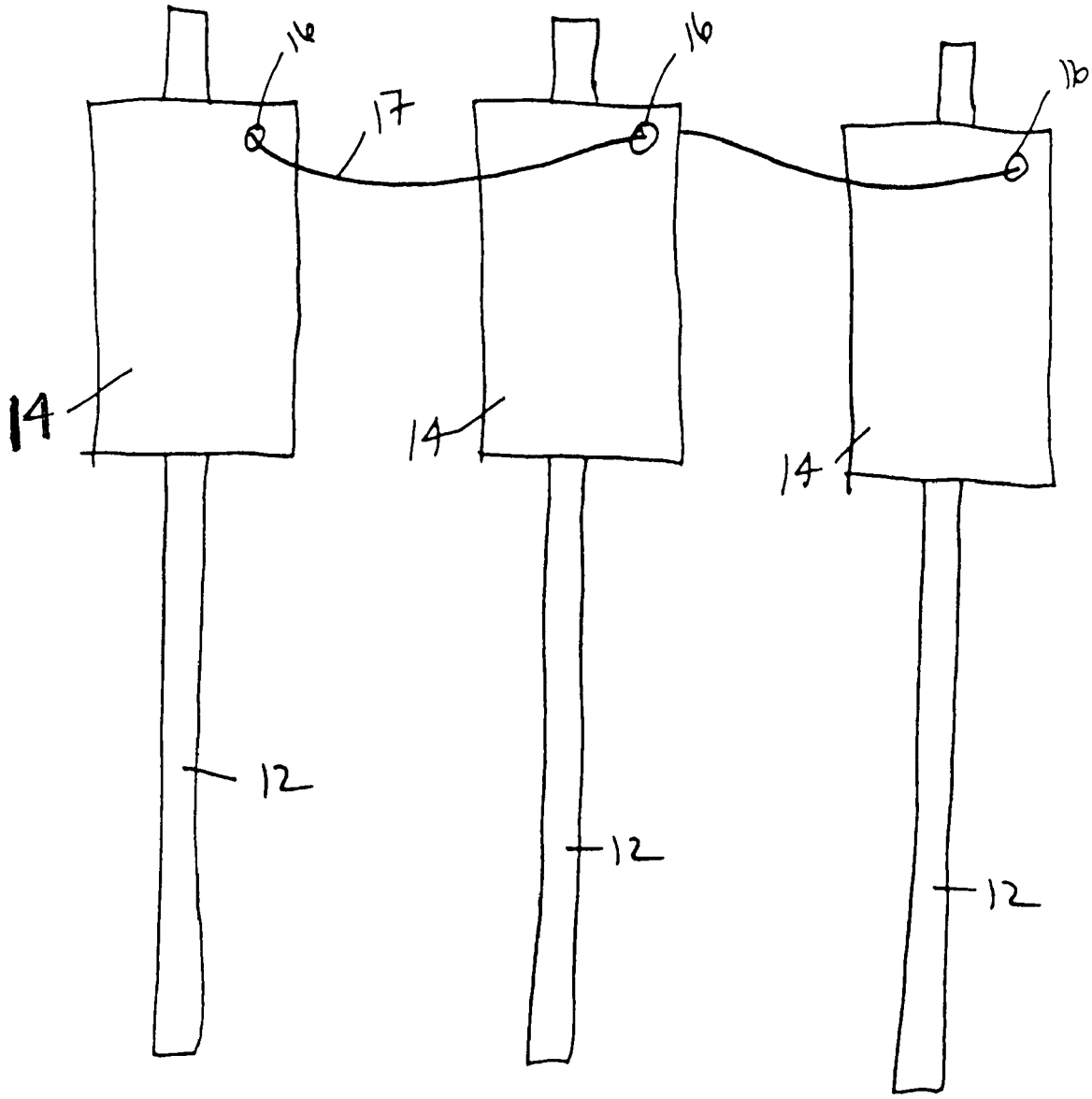
FIG. 8 is a front view of a plurality of plate piles connected by a cable.

Any plate shape may have one or more perforations 16. Cable 17 may optionally be threaded through perforation 16 in a plurality of plate piles 10, as shown in FIG. 5B. Threading cable 17 through perforation 16 of each plate pile 10, as shown in FIG. 8, will increase the lateral strength of the plurality of plate piles 10 and may provide additional slope stabilization, if needed.

In addition, perforation 16 may be used to remove one or more plate piles 10, if needed. In this embodiment, a hook or other similar device is inserted in perforation 16, and used to pull plate pile 10 from the ground. This embodiment may be used if the plate piles were needed during construction, but subsequently were unnecessary. Or, if the plate piles 10 have been used to stabilize a shoreline, subsequent erosion due from the water may require removal of the plate piles. Perforations 16 may be used to remove the plate piles 10.

Various changes and modifications to the presently preferred embodiments will be apparent to those skilled in the art. Such changes and modifications may be made without departing from the spirit and scope of the present invention. The embodiments disclosed herein are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A method for stabilizing a slope comprising:

identifying a slope created by human activity wherein said slope has a surface area bounded by an x-axis and a y-axis, and an acute slope angle that has increased due to human activity, wherein said x-axis is equivalent in length to a horizontal length along a bottom of said surface area, and is substantially parallel to a horizontal plane at said bottom of said slope, and wherein said y-axis is perpendicular to said x-axis resting on said slope surface, and is equivalent in length to said slope;

determining a surface area of said slope by multiplying said x-axis length by said y-axis length;

calculating a sufficient number of plate piles needed to create a series of alternating rows covering said surface area in a diamond-shaped lattice pattern, wherein a first row, and all subsequent odd-numbered rows, contain a plurality of plate piles inserted approximately four feet center-to-center along said x-axis of said slope, wherein a second row, and all subsequent even-numbered rows, contain a plurality of plate piles inserted approximately three to four feet center-to-center parallel to said x-axis of said slope, and wherein said second-row plate piles are centered between said first row plate piles, and said second row is positioned approximately four to ten feet from said first row along said y-axis of said slope, forming a diamond-shaped lattice pattern and wherein all subsequent even and odd rows continue said diamond-shaped lattice pattern;

transporting said calculated number of plate piles to said slope;

inserting a plurality of plate piles below the surface of said slope in a series of alternating rows to create said diamond-shaped lattice pattern covering said slope.

2. The method of claim 1 wherein said human activity is road widening that causes an increase in said slope angle.

3. The method of claim 1 wherein said human activity is golf course construction that causes an increase in said slope angle.

4. The method of claim 1 wherein said human activity is building construction that causes an increase in said slope angle.

5. The method of claim 4 wherein said plates piles are inserted during construction to temporarily stabilize said slope.

6. The method of claim 5 wherein said plate pile is subsequently removed using a perforation in said plate pile.

7. The method of claim 1 wherein said plate piles in a bottom row are spaced approximately three feet center to center.

8. The method of claim 1 wherein said plate piles consist of a plate with a shape, wherein said plate is permanently connected with a pile, and wherein the plate shape is selected from the group consisting of a rectangular shape, a pentahedron shape, a perforated plate with a plurality of perforations, and a modified-w shape.

9. A method for stabilizing a slope in front or behind a structure comprising:

identifying a slope in front or behind a structure with potential for failure by using geologic mapping wherein said slope has a surface area bounded by an x-axis and a y-axis, and a slope angle, wherein said x-axis is equivalent in length to a horizontal length along a bottom of said surface area and substantially parallel to a horizontal plane at said bottom of said slope, and a y-axis wherein said y-axis is perpendicular to said x-axis, resting on said slope surface and is equivalent in length to said slope with potential for failure;

determining said surface area of said slope by multiplying said x-axis length by said y-axis length;

calculating a sufficient number of plate piles needed to create a series of alternating rows covering said surface area in a diamond-shaped lattice pattern, wherein a first row, and all subsequent odd-numbered rows, contain a plurality of plate piles inserted approximately three to four feet center-to-center along the x-axis of said slope, wherein a second row, and all subsequent even-numbered rows, contain a plurality of plate piles inserted approximately three to four feet center-to-center parallel to said x-axis of said slope, and where said second-row plate piles are centered between said first row plate piles, and where said second row is positioned approximately four to ten feet from said first row along said y-axis of said slope, forming a diamond-shaped lattice pattern, and wherein all subsequent even and odd rows continue this pattern;

transporting said calculated number of plate piles to said slope;

inserting a plurality of plate piles below the surface of said slope in a series of alternating rows to create said diamond-shaped lattice pattern covering said slope.

10. The method of claim 9 wherein said structure is selected from the group consisting of power plants, dams, bridge abutments, pipelines, shopping centers, residences, businesses, government facilities, railroads, hospitals, and historical landmarks.

11. The method of claim 9 wherein said plate piles in a bottom row are spaced approximately three feet center to center.

12. The method of claim 9 wherein said plate piles consist of a plate with a shape, wherein said plate is permanently connected with a pile, and wherein the plate shape is selected from the group consisting of a rectangular shape, a pentahedron shape, a perforated plate with a plurality of perforations, and a modified-w shape.

13. A method for stabilizing ground adjacent to water comprising:

identifying a waterfront with a surface area wherein said surface area is unstable ground adjacent to said waterfront, and an x-axis that is equivalent in length to said unstable ground running parallel to said waterfront;

calculating a sufficient number of plate piles needed to create a first row in said ground between one and ten feet inland from said waterfront, where said row contains a plurality of plate piles inserted approximately three feet center-to-center along said x-axis;

inserting said plate piles approximately three feet center-to-center below said ground surface along said x-axis.

14. The method of claim 13 wherein said surface area is determined by multiplying said x-axis length by a y-axis length, wherein said y-axis extends back from, and perpendicular to, said waterfront along said surface, and wherein an additional row of plate piles is inserted three feet center-to-center below said ground surface and between one and ten feet further inland from said first row.

15. The method of claim 13 wherein said plate piles consist of a plate with a shape, wherein said plate is permanently connected with a pile, and wherein the plate shape is selected from the group consisting of a rectangular shape, a pentahedron shape, a perforated plate with a plurality of perforations, and a modified-w shape.

* * * * *